US008948577B2

(12) United States Patent
Eberli et al.

(10) Patent No.: US 8,948,577 B2
(45) Date of Patent: Feb. 3, 2015

(54) HAND-HELD HOT AIR DEVICE WITH A DIGITAL OPERATING DEVICE WITH A UNIVERSAL OPERATING ELEMENT

(71) Applicant: Leister Technologies AG, Kagiswil (CH)

(72) Inventors: Stephan Eberli, Heiligkreuz (CH); Bruno Von Wyl, Kagiswil (CH)

(73) Assignee: Leister Technologies AG, Kagiswil (CH)

( * ) Notice: Subject to any disclaimer, the term of this patent is extended or adjusted under 35 U.S.C. 154(b) by 209 days.

(21) Appl. No.: 13/671,192

(22) Filed: Nov. 7, 2012

(65) Prior Publication Data

US 2013/0129328 A1 May 23, 2013

(30) Foreign Application Priority Data

Nov. 21, 2011 (DE) ..... 20 2011 052 043 U

(51) Int. Cl.

| | |
|---|---|
| ***A45D 20/10*** | (2006.01) |
| ***F24H 3/02*** | (2006.01) |
| ***F24H 3/00*** | (2006.01) |
| ***F24H 3/04*** | (2006.01) |
| ***F24H 9/20*** | (2006.01) |

(52) U.S. Cl.

CPC ..... *F24H 3/002* (2013.01); *F24H 3/0423* (2013.01); *F24H 9/2071* (2013.01)

USPC ..... 392/384; 392/379; 392/383; 392/385

(58) Field of Classification Search

None

See application file for complete search history.

(56) References Cited

U.S. PATENT DOCUMENTS

| | | | | | |
|---|---|---|---|---|---|
| 3,610,881 | A | * | 10/1971 | Stewart | 392/384 |
| 4,629,864 | A | * | 12/1986 | Wilson | 392/385 |
| 4,668,855 | A | * | 5/1987 | Wilson et al. | 392/385 |
| 4,683,370 | A | * | 7/1987 | Petersen et al. | 392/385 |

(Continued)

FOREIGN PATENT DOCUMENTS

WO 84/03552 A1 9/1984

OTHER PUBLICATIONS

German Search Report for corresponding German Application No. 20 2011 052 043.9 dated Sep. 4, 2012.

*Primary Examiner* — Thor Campbell

(74) *Attorney, Agent, or Firm* — Renner, Otto, Boisselle & Sklar, LLP

(57) ABSTRACT

The hand-held hot air device, preferably for the local heating of thermoplastic materials, with a housing that forms a wand-shaped handle part with air inlet openings, and with an air guidance tube that protrudes from the handle part and radially delimits an air canal, with an electric heating element contained in the air guidance tube and an electric motor with a fan wheel contained in the handle part, and with an electronic control system arranged inside the handle part with one semiconductor power switch each arranged upstream of both the heating element and the electric motor, and with a display screen and an operating device for the hand-held hot air device arranged on the outside of the handle part. The electronic control system is implemented as microprocessor control system, the display screen as an electronic digital display, and the operating device as a digital operating device, with the digital operating device comprising a single universal operating element that is movable in at least two directions relative to the handle part for the purpose of switching the hand-held hot air device on and/or off and for determining control data of the microprocessor control system.

12 Claims, 2 Drawing Sheets

(56) References Cited

U.S. PATENT DOCUMENTS

| | | | | | |
|---|---|---|---|---|---|
| 4,788,413 | A * | 11/1988 | Eng | 392/385 |
| 4,996,972 | A * | 3/1991 | Poston | 126/263.01 |
| 5,195,164 | A * | 3/1993 | Lambert | 392/385 |
| 5,671,321 | A * | 9/1997 | Bagnuolo | 392/385 |
| 6,154,201 | A * | 11/2000 | Levin et al. | 345/184 |
| 6,337,469 | B1 * | 1/2002 | Chung | 219/506 |
| 6,636,197 | B1 * | 10/2003 | Goldenberg et al. | 345/156 |
| 6,683,285 | B2 * | 1/2004 | Wyss et al. | 219/536 |
| 7,046,230 | B2 * | 5/2006 | Zadesky et al. | 345/156 |
| 7,091,430 | B1 * | 8/2006 | Haizima et al. | 200/6 A |
| 7,170,497 | B2 * | 1/2007 | Husgafvel et al. | 345/172 |
| 7,368,673 | B2 * | 5/2008 | Sato | 200/5 R |
| 7,420,547 | B2 * | 9/2008 | Takahashi | 345/184 |
| 7,633,485 | B2 * | 12/2009 | Reed et al. | 345/156 |
| 7,717,104 | B2 * | 5/2010 | Looft | 126/25 B |
| 8,103,154 | B2 * | 1/2012 | Steinel et al. | 392/379 |
| 2007/0012306 | A1 * | 1/2007 | Looft | 126/6 |
| 2008/0181590 | A1 * | 7/2008 | Radwill et al. | 392/385 |
| 2012/0062757 | A1 * | 3/2012 | Schindler | 348/220.1 |

* cited by examiner

HAND-HELD HOT AIR DEVICE WITH A DIGITAL OPERATING DEVICE WITH A UNIVERSAL OPERATING ELEMENT

CROSS-REFERENCE TO RELATED APPLICATION

The present application claims priority under 35 USC §119 to German Patent Application No. 20 2011 052 043.9 filed Nov. 21, 2011, the entire disclosure of which is incorporated herein by reference.

TECHNICAL FIELD OF THE INVENTION

The invention relates to a hand-held hot air device, preferably for the local heating of plastic parts or webs, with a plastic housing that forms a wand-shaped handle part with air inlet openings, and with a metallic air guidance tube that protrudes from the handle part and radially delimits an air canal, with an electric heating element contained in the air guidance tube and an electric motor with a fan wheel contained in the handle part, and with an electronic control system for one semiconductor power switch each arranged upstream of the heating element and the electric motor, and with a display screen and an operating device arranged on the outside of the handle part. It specifically relates to a hot air device that is capable of generating a continuous flow of air with a temperature of at least 300° C.

DESCRIPTION OF THE RELATED ART

Such hand-held hot air devices are known in a variety of embodiments. For example, they are employed for fusing plastic parts or plastic webs with each other. The publication WO 84/03552 A1 discloses a hand-guidable hot air generator for fusing or shaping plastic articles where a tube-type housing serving as handle is designed as an air canal that continues in a metal tube that extends the housing. This known device comprises an electrically powered fan for generating a flow of cold air as well as a heating cartridge heated with electric power that converts the flow of cold air to a flow of hot air. This hand-held hot air device comprises a simple electronic control system with a thermo element as temperature sensor as well as an analog control, with the target temperature being selectable by means of a calibrated potentiometer that has a rotary knob extending to the outside, where it is surrounded by a printed-on dial. In addition, a conventional on-off switch is provided on the device that directly follows the power supply cable.

With the hand-held hot air device known from prior art, it is considered to be a disadvantage that the target temperature of the air flow can only be set approximately, and that the actual temperature of the air flow is not detectable. It is another disadvantage that the control system acts only on the heating cartridge, and that the fan and the heating cartridge can not be operated and adjusted independently of each other.

Starting from this prior art, the invention addresses the problem of proposing an improved hand-held hot air device where the power of the electric motor with the fan wheel and of the heating element can be adjusted and controlled with high precision and independently of each other, with the target and the actual temperature of the air flow and the target strength of the air flow being controlled by the electronic control system.

SUMMARY OF THE INVENTION

According to the invention, this problem is solved by a hand-held hot air device as described herein. Additional advantageous embodiments are given in the related claims.

The hand-held hot air device according to the invention for generating a hot air flow comprises an electronic control system implemented as a microprocessor control system, an operating device designed as a digital operating device, and a display screen that is formed by an electronic digital display. Specifically, according to the invention, the operating device comprises only a single universal operating element that is used for switching the device on and off and also for determining, i.e. for inputting, the control data of the microprocessor control system. The universal operating element can be moved in at least two directions relative to the handle part. Preferably, it can be shifted axially and/or can be rotated clockwise or counter-clockwise in the circumferential direction.

In conjunction with the microprocessor control system, the universal operating element permits the digital adjustment of the speed of the electric motor with fan wheel, hereafter referred to as fan, and of the target temperature of the air flow that is generated by the fan and heated by the heating element. The power or voltage adjustment for the heating element is performed continually or re-adjusted at preset brief time intervals by the microprocessor of the microprocessor control system, dependent on the deviation of the actual temperature from the target temperature, with the actual temperature being measured continuously by means of a thermal sensor. The electronic display serves to display important—specifically variable—process parameters of the microprocessor control system. It is capable of digitally displaying the target as well as the actual parameters during the operation or the adjustment of the hand-held hot air device. For example, it comprises a three-and-one-half digit seven-segment display for displaying the target or the actual temperature of the hot air flow, a five-segment bar display for adjusting or displaying the fan speed, as well as a number of symbols for displaying functions of the device. By means of the universal operating element, it is also possible to call up the current settings and possible messages of the microprocessor control system. All provided adjustments and queries of the microprocessor control system are performed by means of the single universal operating element by sliding it in the axial direction, by pushing it one or several times, and/or by rotating it clockwise or counterclockwise. By actuating the universal operating element, it is possible to select the parameters to be changed, to change their value, to call up the status data of the device, or to activate special functions of the device.

Preferably, when the universal operating element is actuated, the operating device bridges electrical contacts that send digital signals to the microprocessor control system.

In a preferred embodiment of the invention, the microprocessor control system selects different adjustment parameters and/or changes them, dependent on how long the universal operating element is actuated. In another embodiment of the hand-held hot air device according to the invention, as an alternative, or in addition, the universal operating element is capable of selecting and/or changing different adjustment parameters dependent on how often the universal operating element is actuated.

Preferably, the universal operating element can be rotated circumferentially in two directions, i.e. it can be rotated clockwise and counterclockwise, selecting and/or changing different adjustment parameters dependent on the rotary direction of the universal operating element. Here, the universal operating element may comprise several contact positions in both rotary directions, with the signals sent to the microprocessor control system for adjusting the operating parameters and/or operating conditions being dependent on the angle of rotation.

Regarding a simple operation of the hand-held hot air device according to the invention, it proved to be favorable if the universal operating element was designed as self-returning, at least in the axial direction. In the rotary direction, the universal operating element may be designed as self-returning or non-self-returning. This depends on whether the universal operating element is designed in this direction as a bit generator or as a switch. In this manner, all operating parameters or operating conditions of the hand-held hot air device can be adjusted in a simple way. In conjunction with the visualization by means of the display, even complex adjustment and setting processes can be shown and performed in a way that is simple to understand.

The universal operating element may be either pushed and/or rotated, or may be simultaneously pushed and rotated or swiveled clockwise or counterclockwise. By combining these two motions, it is possible to generate a multitude of discrete command inputs for the microprocessor. The different commands that lead to different processes depend on how long the universal operating element is pushed (duration), how often the pushing actions are performed in a given time window (frequency), in which direction the universal operating element is rotated with or without simultaneous pushing (rotary direction), and how far the universal operating element is rotated with or without simultaneous pushing (angle of rotation).

In a favored embodiment of the invention, the microprocessor control system comprises a software locking function for the operating device so that the microprocessor control system does not react to an accidental actuation of the universal operating element. This prevents the adjustment parameters for the air volume and the air temperature of the hot air flow as well as the operating conditions of the hand-held hot air device from being accidentally changed in an undesirable manner during the use of the hand-held hot air device according to the invention. In order to override the software locking function, the operating element must be pushed and/or rotated in a certain way that generates a given command code.

The microprocessor control system permits not only a simple control and adjustment of the operating condition and of the set process parameters of the hand-held hot air device but also the specific monitoring of functional elements or of device functions. For example, the microprocessor control system is able to monitor the line voltage present at the heating element under load by means of detection devices provided for detecting the voltage, and determine, by means of provided temperature detection devices, the temperature of the air flow that depends on the proper functioning of the heating element and of the fan. Such detection devices also serve to reliably detect an overheating of the heating element. By means of additional detection devices that are optionally provided for the current and/or the voltage, proper functioning or failures can be detected and signaled to the user via the electronic display screen. As information for the user of the hand-held hot air device, the microprocessor control system displays via the electronic display screen the target and actual values of process parameters, deviations of the process parameters from the set values, messages regarding special operating conditions, as well as warning and/or failure messages. For this purpose, beside the air volume and temperature display, the display comprises symbols that are activated, for example, during software locking of the universal operating element, in case of a defective heating element, when the heating element is overheating, when normal and/or below-normal voltage is present at the heating element, or if maintenance work is due.

In advantageous embodiments of the invention, the microprocessor control system comprises an energy saving function that can be activated via the universal operating element. Such processor-controlled functions are not known from prior art of hand-held hot air devices. This special operating condition is also displayed on the display screen as soon as it is active.

Frequently, users use hand-held hot air devices for the same process. For this, they are adjusted optimally just once and thereafter only switched on and off by means of the universal operating element. When they are switched on, the last process parameters that were used are called up again. Many end users use automatic hot air devices for the essential part of a task, and employ the hand-held hot air device only sporadically for a short period in order to manually work on the areas that cannot be reached by the automatic hot air device. It may take several minutes before a hot air device reaches operating temperature after being switched on. This is why such hand-held hot air devices are frequently switched on when work begins and remain in operation until work ends. While the automatic welding device is in operation and/or the user performs other tasks, known hand-held hot air devices consume large amounts of energy during waiting periods, which is undesirable. In conjunction with semiconductor power switches arranged upstream of the heating element or the fan, the microprocessor control system offers the possibility of a controlled change of the air volume conveyed by the fan and/or of the operating temperature of the heating element for generating the hot air flow. As soon as the desired operating temperature is reached and if the air volume is then readjusted, the process temperature is changed only slightly during the adjustment due to the thermal capacity of the heating element. Meanwhile, the energy consumption of the heating element can also be lowered because the heating element needs to heat only the reduced air volume.

If the hand-held hot air device is no longer needed, overheating of the heating element can be avoided by means of the cooling-down function while it is taken out of operation. With the cooling-down function activated, the heating element is switched off under microprocessor control while the fan keeps running for a while, thereby cooling it. The run-on period of the fan can be preset, i.e. stored in the microprocessor, or may be controlled by sensor. The activated cooling-down function is signaled to the user via the electronic display. At the end of the run-on period, the new hand-held hot air device shuts down completely and automatically and also blocks via software the input of commands via the universal operating element.

In addition, the microprocessor control system is able to output and visualize via the display target and actual values of process parameters, special device functions, warning and/or failure messages, as well as maintenance instructions.

In a preferred embodiment of the invention, the microprocessor control system comprises a start-up locking function that can be influenced via the universal operating element. The start-up locking function prevents the automatic start-up of the hand-held hot air device when operating voltage is applied to it. Due to the use of semiconductor power switches for controlling the power of the fan and of the heating element, the microprocessor of the hand-held hot air device is capable of switching these on or off in a defined way. When the device is connected to the operating voltage, or when the operating voltage becomes available again after a power failure, the air flow is only generated and heated after the user has deactivated the lock by means of a deliberate input on the universal operating element. This is a safety-related advantage for preventing fires after power outages, in contrast to devices equipped with a main switch.

Below, the invention is explained in detail with reference to an embodiment shown in the drawing. Additional characteristics of the invention are given in the following description of the embodiment of the invention in conjunction with the claims and the attached drawing. The individual characteristics of the invention may be realized either individually by themselves or in combinations of several in different embodiments of the invention.

DETAILED DESCRIPTION OF THE INVENTION

Figure 1:
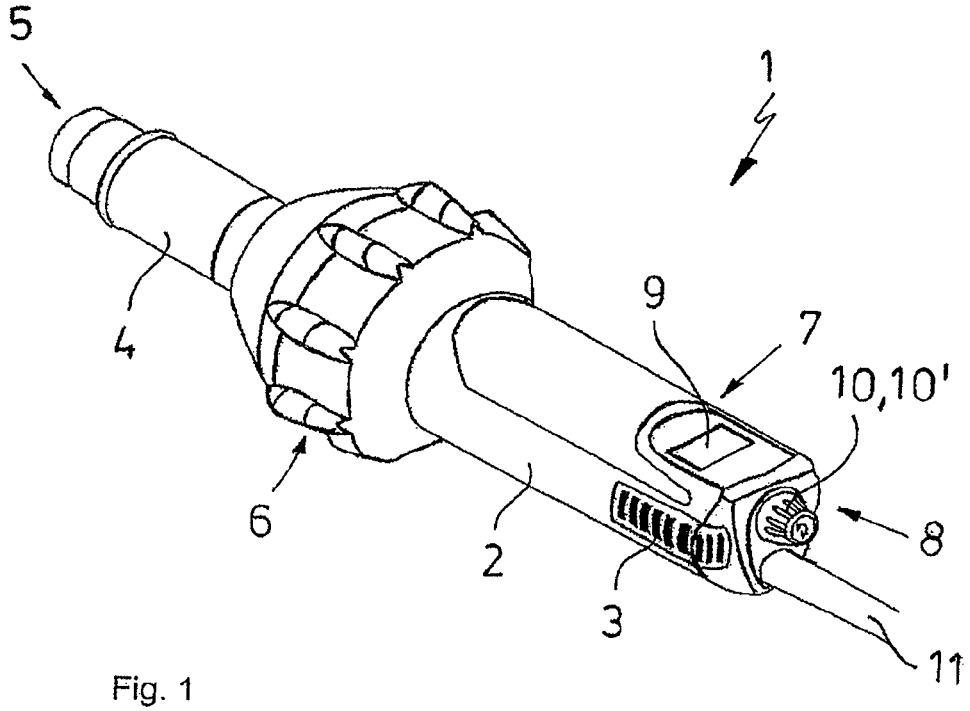
FIG. 1 shows a perspective view of a hand-held hot air device according to the invention, with the handle part shown from the rear.
Figure 2:
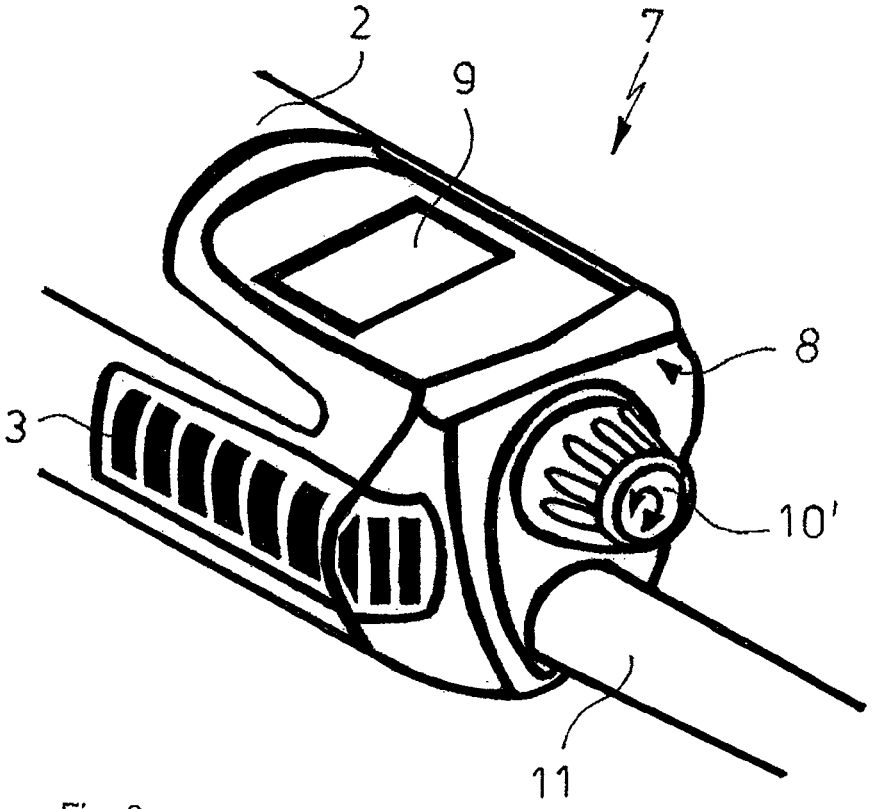
FIG. 2 shows an enlarged detail of the universal operating element from FIG. 2 [sic]

FIG. 1 shows the embodiment of the invention as an overview drawing, FIG. 2 shows the rear end of the embodiment shown in FIG. 1 in an enlarged detail view. The hand-held hot air device according to the invention 1 comprises a wand-shaped handle part 2 with air inlet openings 3 that is implemented as a plastic housing (2'). The air inlet openings 3 are arranged at the rear of the handle part 2. At the front end of the handle part 2, a metallic air guidance tube 4 protrudes that comprises an air outlet opening 5 at its end facing away from the handle part 2, with an air canal (not shown in the Figures) extending inside the housing (2') and the air guidance tube 4 from the air inlet openings 3 to the air outlet opening 5. At the transition to the air guidance tube 4, the cylindrical handle part 2 comprises an equally cylindrical front housing section 6 the diameter of which, however, is significantly larger than the rear housing section 7 of the handle part 2. Inside the handle part 2, in the area of the front housing section 6, an electric motor with a fan wheel is arranged, and in the air guidance tube 4 an electric heating element is arranged, downstream from the fan (both not shown).

In addition, a microprocessor control system (not shown) with one semiconductor power switch each upstream of the heating element and the electric motor is installed between the fan and the rear face 8 of the handle part 2. The microprocessor of the microprocessor control system is electrically connected to an electronic digital display screen 9 in the form of the display 9 and to an operating device 10 that are both arranged on the rear housing section 7 of the handle part 2 and are visible or operable from the outside. The operating device 10 comprises a single universal operating element 10' that is implemented as an essentially cylindrical rotary knob and projects from the handle part 2. The universal operating element 10' is arranged at the rear face 8 of the handle part 2 where the power cord 11 also enters the rear housing section 7 of the handle part 2. The display 9 is also arranged at the rear housing section 7 of the handle part 2 close to the rear face 8, but on the circumference, where the air inlet openings 3 of the air canal are also positioned.

The universal operating element 10', shown as an enlarged detail in FIG. 2, that feeds digital inputs as commands to the microprocessor can be shifted axially and rotated in the circumferential direction for the purpose of inputting control data. When the universal operating element 10' is actuated, the operating device 10 bridges electrical contacts that are connected to the microprocessor, thereby transmitting signals to the microprocessor.

Figure 3:
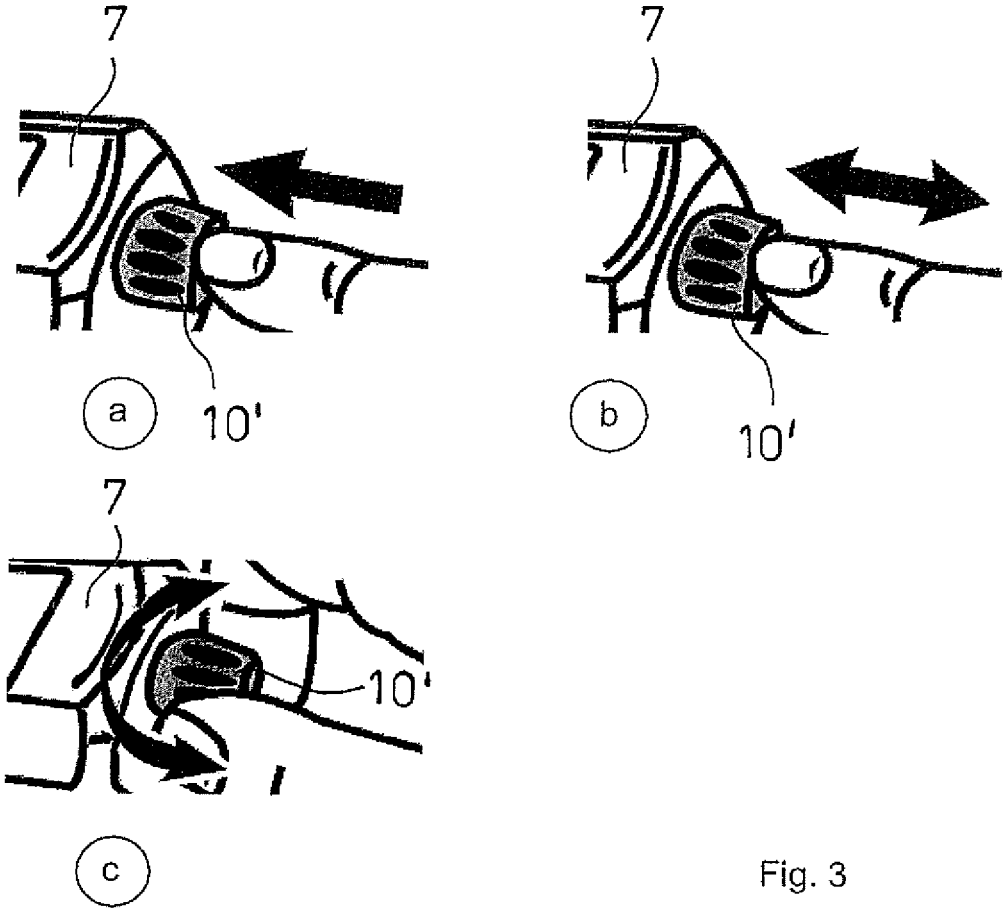
FIG. 3 shows the various actuation modes of the universal operating element from FIG. 2 (FIGS. 3*a* to 3*c*)

FIGS. 3*a* to 3*c* show the different actuation options of the universal operating element 10' that are provided. In the axial direction, the universal operating element 10' is configured as a keying device, as shown symbolically by FIGS. 3*a*, 3*b*. The operating device 10 that can be actuated by means of the universal operating element 10' emits different digital signals for adjusting the operating condition or operating parameters of the hand-held hot air device 1, depending on the duration of the axial actuation. Also, dependent on the frequency of the axial actuation within a certain time window, it emits other signals for adjusting the hand-held hot air device 1. As FIG. 3*c* shows, the universal operating element 10' can be rotated in the circumferential direction in both possible directions of rotation. Also depending on the direction of rotation or the angle of rotation, the universal operating element 10' sends additional signals of a different type to the microprocessor control system for adjusting other operating conditions or operating parameters of the hand-held hot air device 1. In addition, the combination of keying and rotary motions produces yet another sequence of commands.

Figure 4:
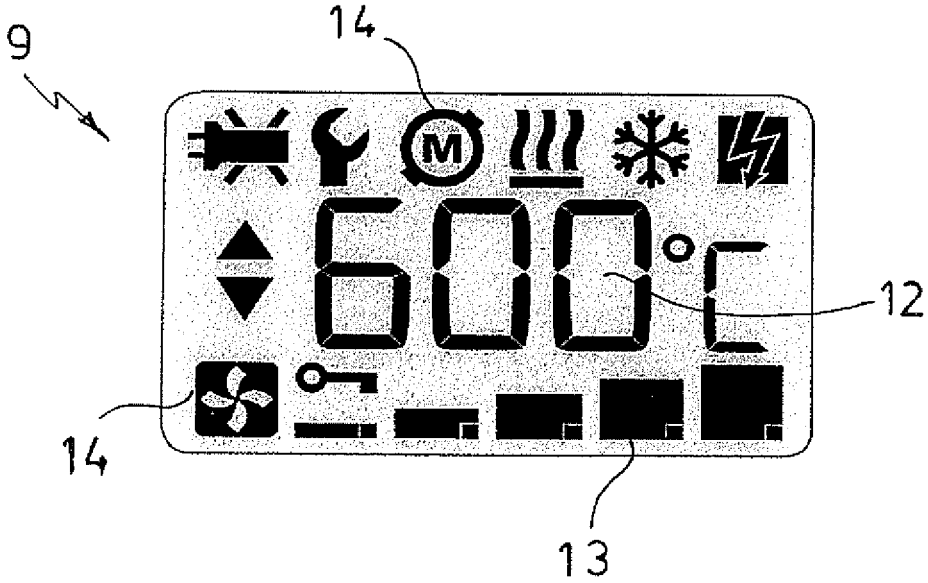
FIG. 4 shows the electronic display from FIG. 2 as an enlarged detail.

FIG. 4 shows the electronic digital display 9 of the hand-held hot air device 1 in an enlarged view. In the center, the display 9 comprises a 3-digit 7-segment display 12 for the temperature input and display. A 5-segment bar display 14 for adjusting or displaying the air volume is arranged below that. Above and to the left of the 3-digit 7-segment temperature display 12, a number of function symbols 14 are arranged for displaying warning or failure messages or certain special operating conditions of the hand-held hot air device 1. For displaying temperatures in ° F., a digit representing one thousand must also be displayed at 700° C. This digit is located between the triangle symbols and the number 6 in FIG. 4. Since the 1,000 digit is only used to display 1 or nothing, this is half a digit.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. A hand-held hot air device, with a housing that forms a wand-shaped handle part with air inlet openings, and with an air guidance tube that protrudes from the handle part and radially delimits an air canal, with an electric heating element contained in the air guidance tube and an electric motor with a fan wheel contained in the handle part, and with an electronic control system arranged inside the handle part with one semiconductor power switch each arranged upstream of the heating element and the electric motor, and with a display screen and an operating device for the hand-held hot air device arranged on the outside of the handle part wherein the electronic control system is implemented as microprocessor control system and the display screen as an electronic digital display and the operating device as a digital operating device, with the digital operating device comprising a single universal operating element that is movable in at least two directions relative to the handle part for the purpose of switching the hand-held hot air device on and off and for determining control data of the microprocessor control system;

wherein:

the universal operating element can be shifted axially and/or rotated in the circumferential direction, depending on the duration of the actuation of the universal operating element, the microprocessor control system selects and/or changes different adjustment parameters, and depending on the frequency of the actuation of the universal operating element, the microprocessor control system selects and/or changes different adjustment parameters.

2. The hand-held hot air device according to claim 1, wherein when the universal operating element is actuated, the actuation device bridges electrical contacts that transfer digital signals to the microprocessor control system.

3. The hand-held hot air device according to claim 1, wherein the universal operating element has two directions of rotation in the circumferential direction and, depending on the direction of rotation, selects and/or changes different adjustment parameters.

4. The hand-held hot air device according to claim 1, wherein the universal operating element has more than one contact position in both directions of rotation, with the signals for adjusting the operating conditions being dependent on the angle of rotation.

5. The hand-held hot air device according to claim 1, wherein the universal operating element is implemented with an automatic return function.

6. The hand-held hot air device according to claim 1, wherein the microprocessor control system comprises a software locking function for the universal operating element.

7. The hand-held hot air device according to claim 1, wherein the microprocessor control system comprises means of detection for detecting the voltage.

8. The hand-held hot air device according to claim 1, wherein the microprocessor control system comprises means of detection for detecting the temperature.

9. The hand-held hot air device according to claim 1, wherein the microprocessor control system comprises an energy savings function that can be activated via the universal operating element.

10. The hand-held hot air device according to claim 1, wherein the microprocessor control system comprises a cool-down function that can be activated via the universal operating element.

11. The hand-held hot air device according to claim 1, wherein the microprocessor control system outputs target and actual values of process parameters, device functions, warning and/or failure messages, and displays them via the display.

12. The hand-held hot air device according to claim 1, wherein the microprocessor control system comprises a start-up locking function that can be influenced via the universal operating element.

* * * * *